US006820394B2

(12) United States Patent
Plourde

(10) Patent No.: US 6,820,394 B2
(45) Date of Patent: Nov. 23, 2004

(54) METHOD FOR FORMING ZIPPERED THERMOFORMED PACKAGES

(75) Inventor: Eric P. Plourde, Homewood, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/106,684

(22) Filed: Mar. 25, 2002

(65) Prior Publication Data

US 2003/0177738 A1 Sep. 25, 2003

(51) Int. Cl.[7] ..... B65B 47/02; B65B 61/18

(52) U.S. Cl. ..... 53/412; 53/453; 53/133.4; 53/559

(58) Field of Search ..... 53/453, 559, 412, 53/133.2, 139.4; 493/213, 214, 927

(56) References Cited

U.S. PATENT DOCUMENTS

| | | | | | |
|---|---|---|---|---|---|
| 4,437,293 | A | * | 3/1984 | Sanborn, Jr. | 53/453 |
| 4,709,398 | A | * | 11/1987 | Ausnit | 53/139.2 |
| 5,085,031 | A | * | 2/1992 | McDonald | 53/412 |
| 5,163,269 | A | * | 11/1992 | Williams | 53/412 |
| 5,823,933 | A | * | 10/1998 | Yeager | 493/927 |
| 5,937,615 | A | * | 8/1999 | Forman | 53/133.4 |
| 6,044,621 | A | * | 4/2000 | Malin et al. | 53/412 |
| 6,071,011 | A | * | 6/2000 | Thomas et al. | 383/64 |
| 6,099,451 | A | * | 8/2000 | Mulder et al. | 53/139.2 |
| 6,138,439 | A | * | 10/2000 | McMahon et al. | 53/133.4 |
| 6,244,021 | B1 | * | 6/2001 | Ausnit et al. | 53/412 |
| 6,327,837 | B1 | * | 12/2001 | Van Erden | 53/412 |
| 6,588,176 | B1 | * | 7/2003 | Buchman | 53/412 |

FOREIGN PATENT DOCUMENTS

| | | | | |
|---|---|---|---|---|
| GB | 2085519 | * | 4/1982 | 53/412 |

* cited by examiner

*Primary Examiner*—John Sipos
(74) *Attorney, Agent, or Firm*—Pitney Hardin LLP

(57) ABSTRACT

A method of forming, filling and sealing a reclosable package 46. A thermoform film 14 is fed toward a forming station 18. A zipper length 20 having mated interlocking profiles 21 and 23 and a slider 28 is fed onto the thermoform film transverse to the feeding direction of the film and one of the profiles is sealed to the film. A pocket 18 is thermoformed in the film and product 32 is fed into the pocket. A cover sheet 34 is then fed over the thermoform film covering the pocket 18 and second profile 23. The cover sheet 34 is sealed to the thermoform film at seal lines 38 along the pocket, to the second profile and above the zipper to form a filled package and the bottom seal 44 for the next package.

4 Claims, 1 Drawing Sheet

METHOD FOR FORMING ZIPPERED THERMOFORMED PACKAGES

BACKGROUND OF THE INVENTION

The present invention relates to the manufacture of packages and, in particular to the manufacture of zippered, thermoformed packages.

Where a package conforming to the shape of the contained contents is desired or where a pocket to contain the contents is desired or required of a package, it is common to form at least a portion of the package of a thermoform film. During package production the thermoform film is heated and then may be vacuum formed partially about the product or into the desired shape. The process particularly lends itself to in-line form, fill and seal operations. It has become increasingly common to provide zippers on primary packaging, such as for foods. This permits a consumer to open the package, remove some of the package contents and then securely reclose the package to retain the remainder of the contents. Consumer's also appear to prefer having sliders on the zipper to open and close the zipper.

SUMMARY OF THE INVENTION

The present invention provides a method for manufacturing a thermoform package equipped with a zipper. In accordance with the present invention a thermoform film is fed toward a forming station. A zipper length is applied onto the thermoform film transverse to the feeding direction of the film. The zipper has a first profile with a first interlocking member that lies on the film and a second profile atop the first profile with a second interlocking member mated with the first interlocking member. The first profile is sealed transversely across said film. The film is then advanced to the forming station where the pocket is thermoformed in the film. Product is then fed into the pocket and a cover sheet is fed over the thermoform film and over the second profile. The cover film is then sealed to the thermoform film about the pocket and to the second profile forming a filled package which is severed from the thermoform film upstream of the zipper. The zipper may be slider-less or it could contain a slider in which case the zipper slider would be oriented away from the product.

A peel seal may be provided on the product side of the zipper to provide tamper evidence for the package or to enable the pocket to be hermetically sealed. The peel seal could join the cover sheet and thermoform film or flange portions of the zipper to each other or to one of the

DETAILED DESCRIPTION OF THE PREFERRED EMBODIMENT

Figure 1:
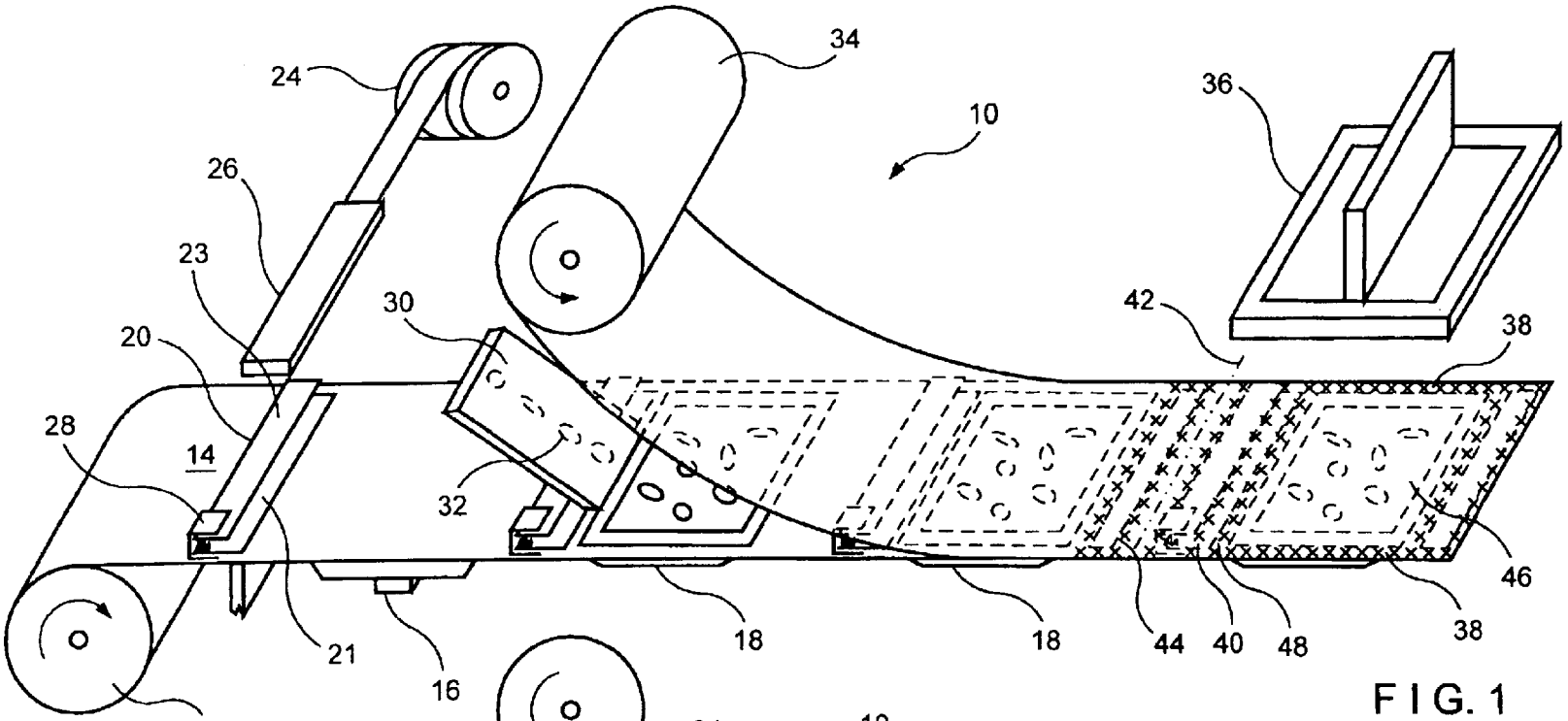
FIG. 1 is a schematic perspective view of a production line for practicing the method of the present invention.
Figure 2:
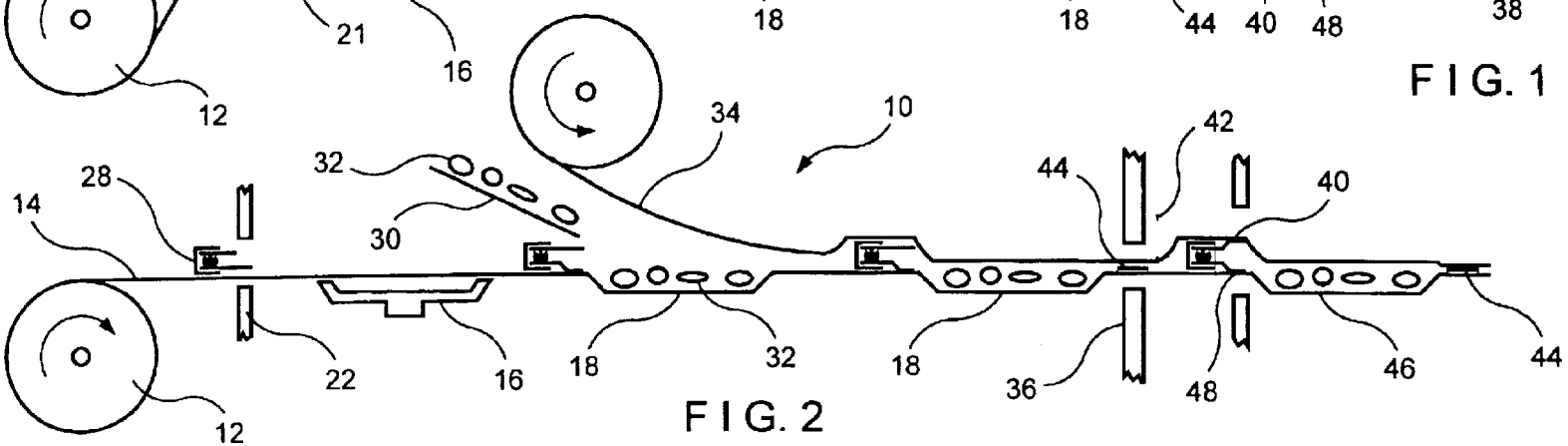
FIG. 2 is a side elevational view thereof.

Reference is now made to the drawings wherein a horizontal form, fill and seal machine 10 for practicing the present invention is depicted. A roll 12 of thermoform film feeds a continuous length of film 14 toward a forming station 16 at which a product receiving pocket 18 is formed. Upstream of the forming station 16 a length of zipper 20 is guided across the film and sealed to the film by seal bars 22. The zipper 20 is fed from roll 24 through an applicator 26 at which a slider 28 is attached to the zipper. Zipper 20 comprises a pair of profiles 21 and 23 having mating interlocking portions. The zipper is fed onto the film with profile 21 on the film and profile 23 on top of profile 21. Profile 21 is then sealed to film 14 with profile 23 mated and slider 28 positioned on the zipper.

Film 14 then feeds past hopper 30 through which product 32 is fed into pocket 18. Alternatively the product 32 could be fed onto the thermoform film while flat and the pocket 18 formed about the product. In either case, after the product 32 is positioned within pocket 18 a cover film 34 is fed over the thermoformed film and the thermoform film and cover film are fed past a sealing station 36 and the package is completed by side seams 38 formed on opposite sides of the package and cross seam 40 which seals profile 23 to the cover sheet 34, severs the completed, sealed package 46 at separation line 42 and simultaneously seals the thermoform sheet 14 to the cover sheet 34 upstream of the zipper at cross seam 44 to create the bottom seal of the next package.

To provide tamper evidence and/or permit hermetic sealing of package 46 a peel seal 48 may be provided downstream of zipper 20. The peel seal must be ruptured upon the first opening of the package thereby providing evidence of the package having been opened.

Thus in accordance with the above the zippered thermoformed package may effectively be produced.

Having thus described the invention, what is claimed is:

1. A method of forming, filling and sealing a reclosable package comprising the steps of:

feeding a thermoform film toward a forming station;

applying a zipper length onto said film transverse to the feeding direction of the film, said zipper length having a first profile with a first flange extending from a first interlocking member and a second profile atop said first profile with a second flange extending from a second interlocking member mated with said first interlocking member and a slider straddling said interlocking members;

sealing a portion of a width of said first flange to said film transversely across said film;

subsequent to said applying step, thermoforming a pocket in said film;

feeding product into said pocket;

feeding a cover sheet over said thermoform film and over said second profile;

sealing said cover sheet to said thermoform film about said pocket and to a portion of a width of said second flange to form a filled package; and severing said filled package from said thermoform film upstream of said zipper length.

2. The method in accordance with claim 1 wherein said cover sheet is sealed to said thermoform film about three sides of said pocket and to said zipper length about a fourth side of said pocket.

3. The method in accordance with claim 1 wherein said zipper length is applied to said film with said slider directed away from said pocket.

4. The method in accordance with claim 1 wherein said filled package is severed from thermoform film as said cover sheet is sealed to said thermoform film.

* * * * *